United States Patent [19]

See

[11] Patent Number: 4,688,359

[45] Date of Patent: Aug. 25, 1987

[54] STORAGE AND DISPLAY SYSTEM

[76] Inventor: Jacques L. See, 10800 Vicenza Way, Bel Aire, Calif. 90077

[21] Appl. No.: 806,455

[22] Filed: Dec. 9, 1985

[51] Int. Cl.[4] ..... E04H 13/00

[52] U.S. Cl. ..... 52/134; 52/28; 52/104; 52/128

[58] Field of Search ..... 52/134, 128, 103, 104, 52/28; 27/1

[56] References Cited

U.S. PATENT DOCUMENTS

| | | | |
|---|---|---|---|
| 617,161 | 1/1899 | Hunter | 52/134 X |
| 1,096,758 | 5/1914 | Rogers | 52/134 X |
| 2,009,724 | 7/1935 | Bircher | 27/1 |
| 2,013,377 | 9/1935 | Debs | 52/104 |
| 2,358,009 | 9/1944 | Hogsten et al. | 52/104 X |
| 2,513,951 | 7/1950 | McClellen | 27/1 |
| 2,562,726 | 7/1951 | MacDonald et al. | 27/1 |
| 2,827,354 | 3/1958 | Wassell et al. | 312/107 X |
| 3,417,521 | 12/1968 | Welsh | 52/134 X |
| 3,529,730 | 9/1970 | Thompson | 52/134 X |
| 3,648,422 | 3/1972 | Tate, Jr. | 52/104 |
| 3,990,198 | 11/1976 | Ortutay | 27/1 X |
| 4,304,076 | 12/1981 | Splendora | 52/104 |
| 4,428,168 | 1/1984 | Tomer | 52/104 |

FOREIGN PATENT DOCUMENTS

| | | | |
|---|---|---|---|
| 1384392 | 11/1964 | France | 52/104 |

*Primary Examiner*—Alfred C. Perham

*Attorney, Agent, or Firm*—Bogucki, Scherlacher, Mok & Roth

[57] ABSTRACT

A mausoleum for cremated remains includes linear and columnar displays of arrays of transparent display vessels which are relatively small but illuminated to have individual prominence as well as a pleasing aesthetic effect. The vessels rest on linear and columnar displays in secured positions but can be rearranged if desired. The enclosure may be of cruciform outline so as to provide visual variety and to permit expansion in a natural manner.

18 Claims, 10 Drawing Figures

FIG.8
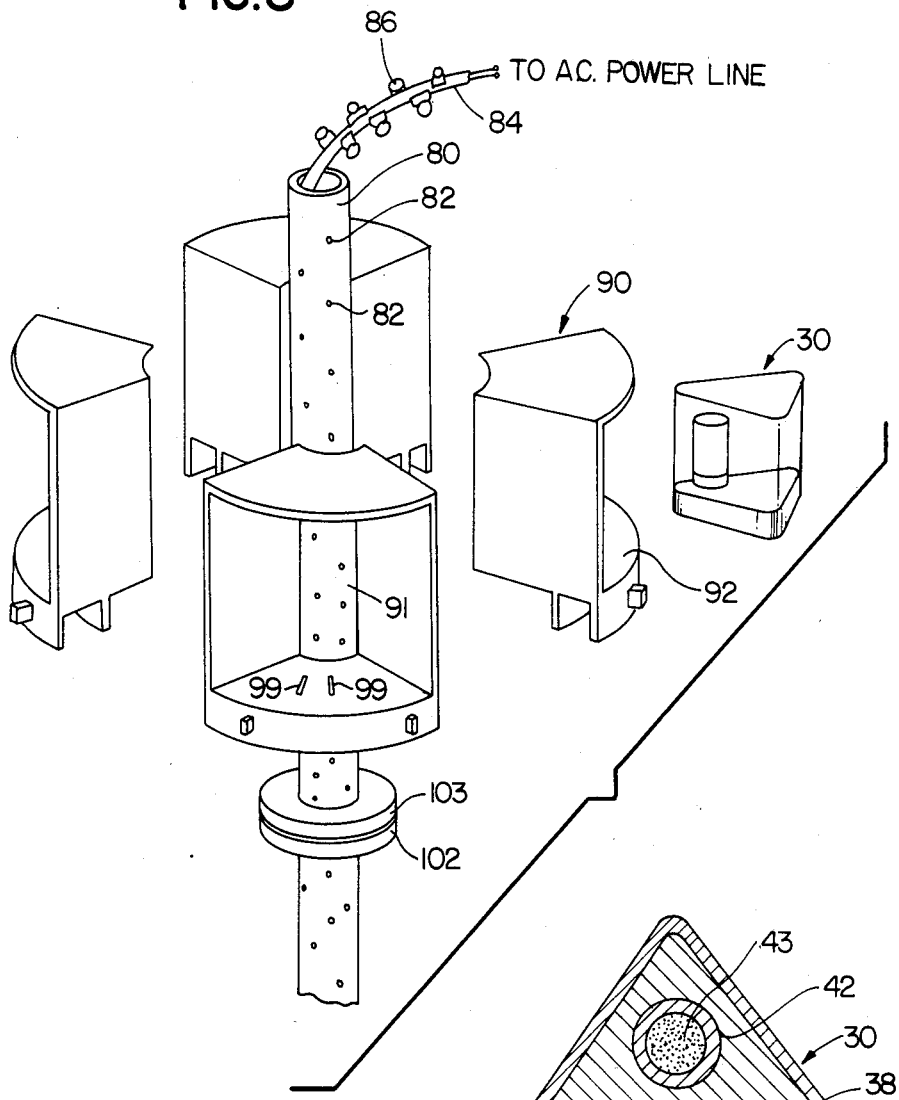
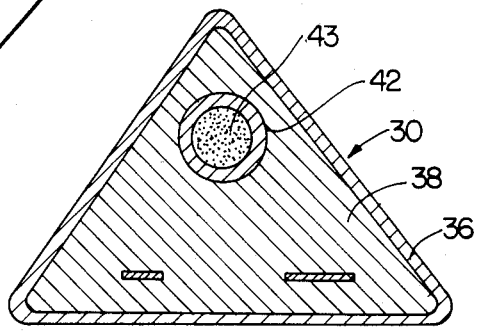
FIG.6

STORAGE AND DISPLAY SYSTEM

BACKGROUND OF THE INVENTION

For social, economic and philosophical reasons, the public has increasingly turned to cremation of the remains of a deceased as an acceptable alternative to preservation and burial. After cremation, the ashes of the decedent are sometimes distributed in accordance with particular wishes, but more often are deposited in urns for storage purposes. The urns may be retained by the family, but usually are held in permanent storage in a mausoleum having walls defining separate compartments. The compartmented walls may be exposed or in an appropriately designated room. For reasons of dignity and appearance, the chambers are large and the compartments usually extend from the floor to a high ceiling. The compartment doors are of a permanent material, such as marble, and provide access only to those having a key. The urns typically contain all of the ashes of the decedent, but are not intended to be viewed.

This type of mausoleum must take advantage of all available wall space, which means that the large interior volume of a chamber cannot be used for any other purpose than creating a visual impression of dignity and permanence. Moreover, compartments at the lowest levels are accessible but inconvenient, and compartments at the highest levels are accessible only by portable steps or other means. Such mausoleums for cremated remains therefore are quite impersonal and have become strictly traditional by virtue of the fundamental assumptions that the urns are to contain all of the remains of the decedent, the compartments must be closed, and that a facade must be employed that is of essentially permanent materials.

With the increasing popularity of cremation, there is a perception of a need for less impersonal and more attractive and meaningful systems for storage and display. Such systems should permanently preserve the ashes and respect the dignity of the decedent. They should also, however, allow reasonable accessibility in an appropriate atmosphere, that may be chosen in accordance with the decendent's or descendant's wishes.

SUMMARY OF THE INVENTION

A mausoleum in accordance with the present invention comprises a compact storage and display system formed of spaced apart geometrical support structures within a building of given geometry. The support structures each retain in ordered fashion a plurality of at least partially transparent storage vessels having interior personalized memorabilia as well as an urn for ashes. The support structures are configured to provide an ordered architectural effect as background, while the vessels on the structures are equally illuminated, such that they become the primary objects of attention when parts of the display are viewed in closer detail. With small, spaced apart, transparent illuminated vessels that internally reflect light and with adjacent individual illumination each vessel provides a visual focal point. Geometric placement of linear and columnar displays having different levels for holding the vessels enables storage and presentation in a coherent, dignified manner of the remains and memorabilia of a number of decedents.

An advantageous form of building in accordance with the invention is cruciform in plane, for purposes of efficient internal display, ready expansion, and external appearance. Linear displays are disposed along the centers of the arms, and columnar displays along the walls, providing many viewing aspects while avoiding repetition.

Further in accordance with the invention, the vessels are disposed on the support structures so that they are both readily accessible and substantially equally emphasized. In one example suitably proportioned monolithic transparent vessels are placed closely together along linear shelves and in rotary columns at successive levels, so as to be visible from different angles under non-concentrated lighting. The arrays of illuminated vessels create wall and column effects within the chamber, so that the vessels are given substantially equal emphasis in an aesthetic background. This compact array of vessels within a relatively small chamber is particularly suitable for retention, in each vessel, of only a small part of the individual decedent's ashes. Thus an individual decedent can choose to be permanently represented, alternatively or concurrently, in a geographical location of particular historical or personal significance, in a site with others having a common cause or endeavor during life, or in a place so as to be together with those having a common religious or ethnic bond.

The vessels and support structure include means for locking the vessels in place at selectable positions and means for illuminating each vessel in isolation relative to the remainder. The permanent personalizing effect may include identifying indicia, medals and awards accrued during the individual's life, photographs and the like. The principal object in view within the vessel, however, is a sculptured opaque urn containing ashes, confirming to a common theme. The individually personalized items within the vessels further contribute to reinforcement of the bond existing between the various decedents.

In one example of a system in accordance with the invention, the vessels comprise triangular sided bodies having glass walls and a monolithic interior in which a decorative urn for retaining ashes is permanently embedded along with identifying information and memorabilia. The linear support structure includes opaque and at least partially hollow shelving within which an interior latching mechanism engages elements protruding from the underside of the vessels, the ends of these latching elements being concealed within and locked in end panels. The vessels on the linear shelves alternate in direction and are isolated from adjacent vessels by sinuous or zig-zag light barriers running along the shelves. Similar vessels are disposed on quadrant niches forming successive levels in columnar displays placed in rows within the chamber. The quadrant niches are individually rotatable for viewing chosen vessels, and mounted about a central shaft through which light is directed into the vessels. Columnar displays placed along side walls impart the effect of providing structural support for the ceiling while also enabling high density display use of this region. Central illumination of the vessels at the different levels, together with internal refraction and reflection of light within the vessels, illuminates the interior of the vessels themselves.

BRIEF DESCRIPTION OF THE DRAWINGS

A better understanding of the invention may be had by reference to the following description, taken in conjunction with the accompanying drawings, in which:

FIG. 6 is a plan sectional view of one of the vessels;

FIG. 8 is a simplified exploded view, partially broken away, of the columnar storage arrangement utilized in the system of FIGS. 1 and 2;

DETAILED DESCRIPTION OF THE INVENTION

Figure 1:
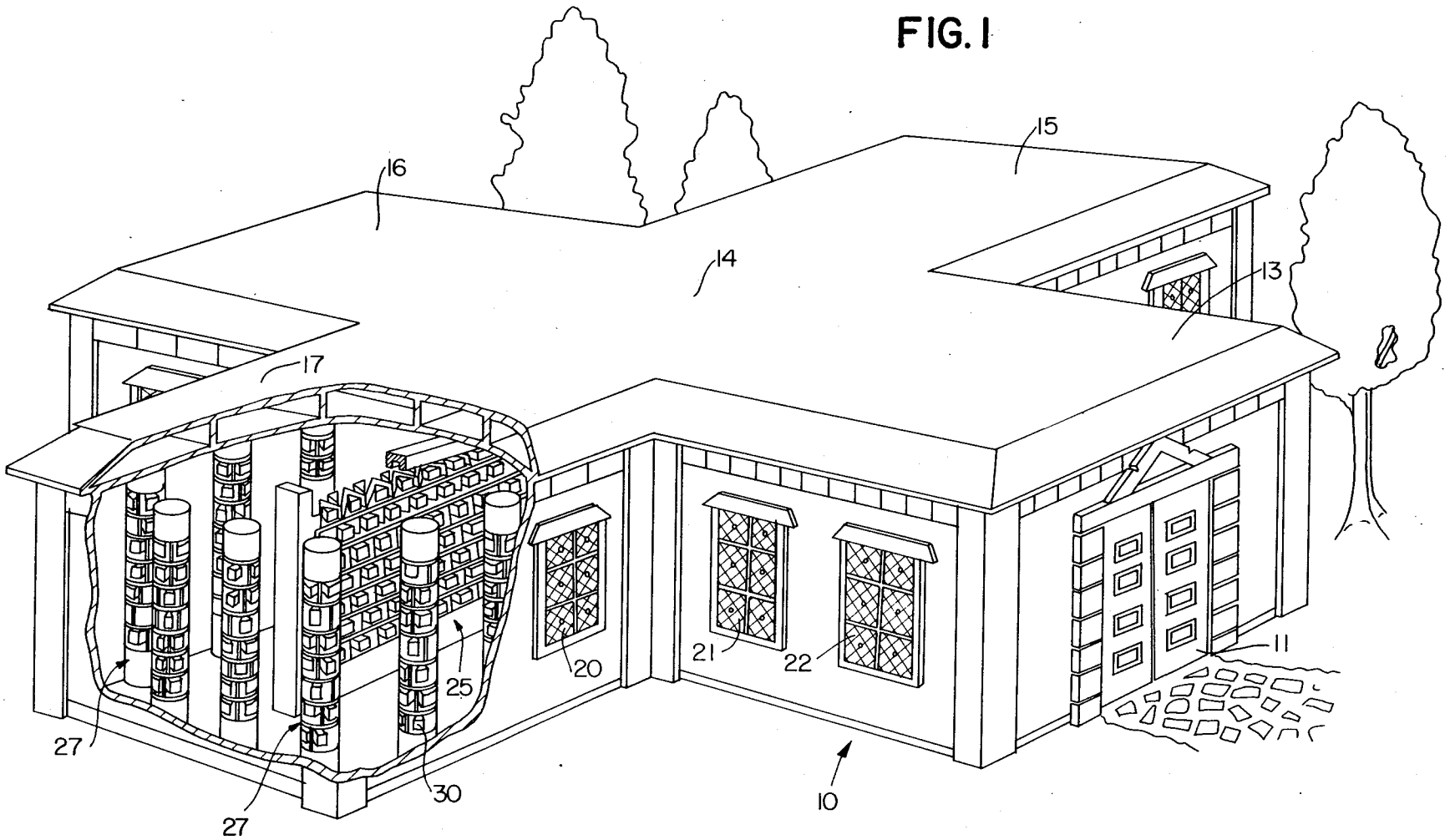
FIG. 1 is a simplified perspective view, partially broken away, of a mausoleum structure containing a storage and display system in accordance with the invention.

A storage and display system for cremated remains in accordance with the invention, referring now to FIG. 1, comprises a substantially cruciform enclosure structure 10 having appropriately strengthened and reinforced walls that resist penetration except in response to heavy machinery or similar major effort. The exterior of the enclosure may incorporate Grecian or similar traditional motifs, and a single door 11 also provides a secure, force resistant part of the structure. Means that may be utlized for insulation, air conditioning, air cicrulation, access control and other expedients have not been shown, for brevity and simplicity. the enclosure structure 10 is of relatively small size, typically 30'×30', with the arms of the cruciform being 10'×10'.

Figure 3:
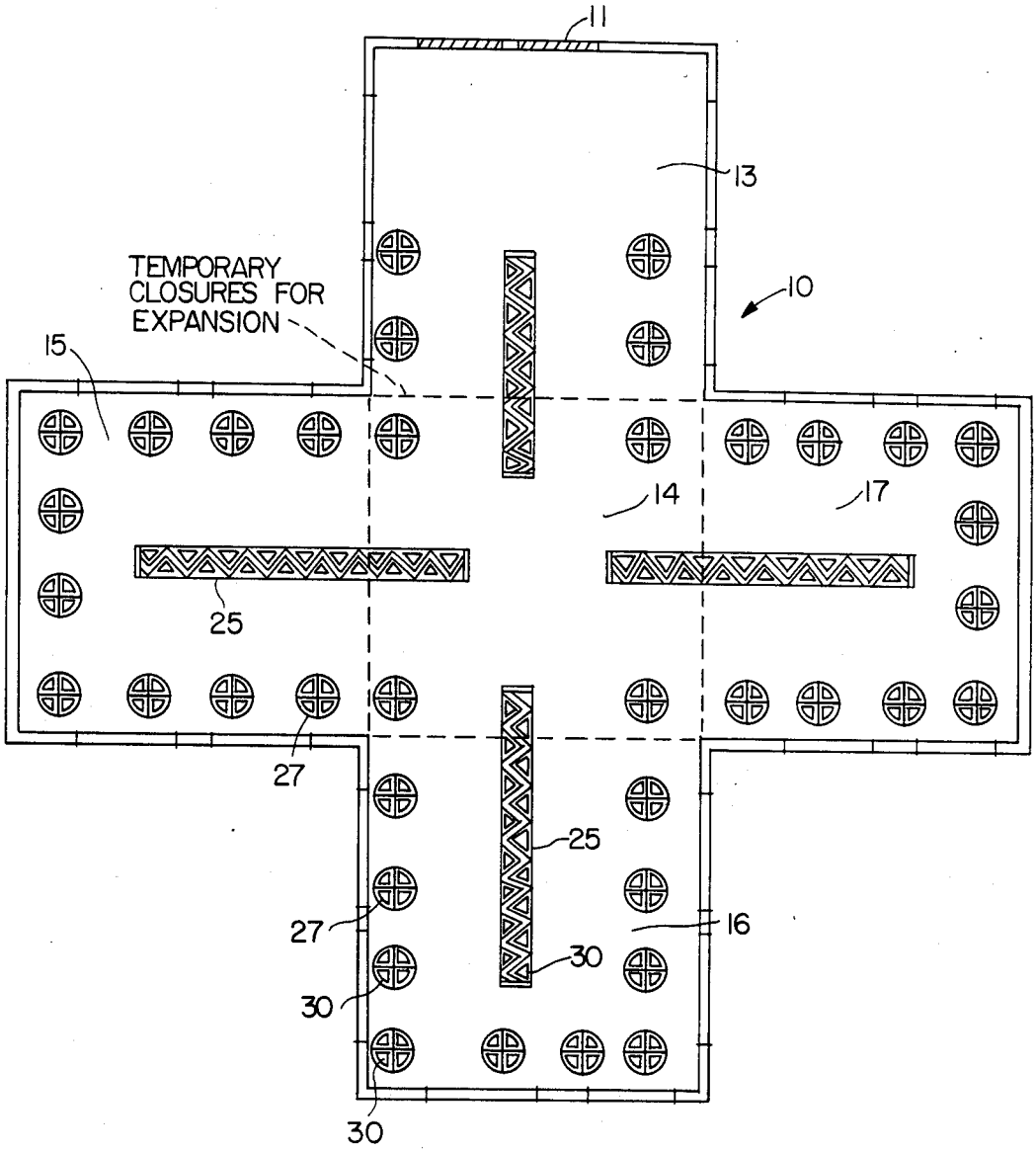
FIG. 3 is a simplified plan view of the interior of the mausoleum structure of FIG. 1, showing the disposition of linear and columnar support structures therein.

The cruciform shape is particularly suitably because of its versatility and efficiency in providing storage and display areas. Thus an entry arm 13 including the entry door 11 can be closed off with a temporary wall at its opposite end when the mausoleum structure 10 is first opened. Thereafter, as seen in the plan view of FIG. 3, the display can be expanded into the center section 14, with the right, back and left arms 15, 16, 17 respectively (as seen from the entry) being closed off temporarily. As more displays are added, the right, back and left arms 15, 16, 17 can be made accessible in any order. Thus, for example, the sections may form a L-shape, then a T-shape, and finally the full cruciform. Consequently, with displays constantly being accumulated until capacity is reached a number of important advantages are derived. The individual displays are not overwhelmed in a substantially greater volume giving an impression of emptiness. Furthermore, although some limited rearrangements may be necessary, each individual display is kept close to its permanent location. Security for the displays is retained throughout.

Alternatively, other sections of the final building may be added as more space is needed. Using prefabricated structures having frame elements and reinforced panels, walls can be removed and new rooms added without substantial disruption of the interior.

Exterior windows 20 having stained glass panels 21 and structural cross bars 22 are use for soft exterior lighting with security. The opacity of the panels 21 and the number and strength of the cross bars 22 can be varied as desired. Curtains can be used to close off the exterior lighting when it becomes too bright.

The storage and display system preferably, although not necessarily, is intended for permanent retention of only a part of the ashes of a number of individuals having a community of interest. Such individuals may, for example, be united by virtue of a common ethnic background, association in a fraternal or military group, or support of a common cause. A typical example is in the return of ashes to a country of origin or a revered religious center. Because the displays are intentionally small and compact, the usage of the remains will generally purposefully utilize only a small portion of the ashes. This enables the decedent to be represented in a number of different mausoleums for different reasons or associations.

Figure 2:
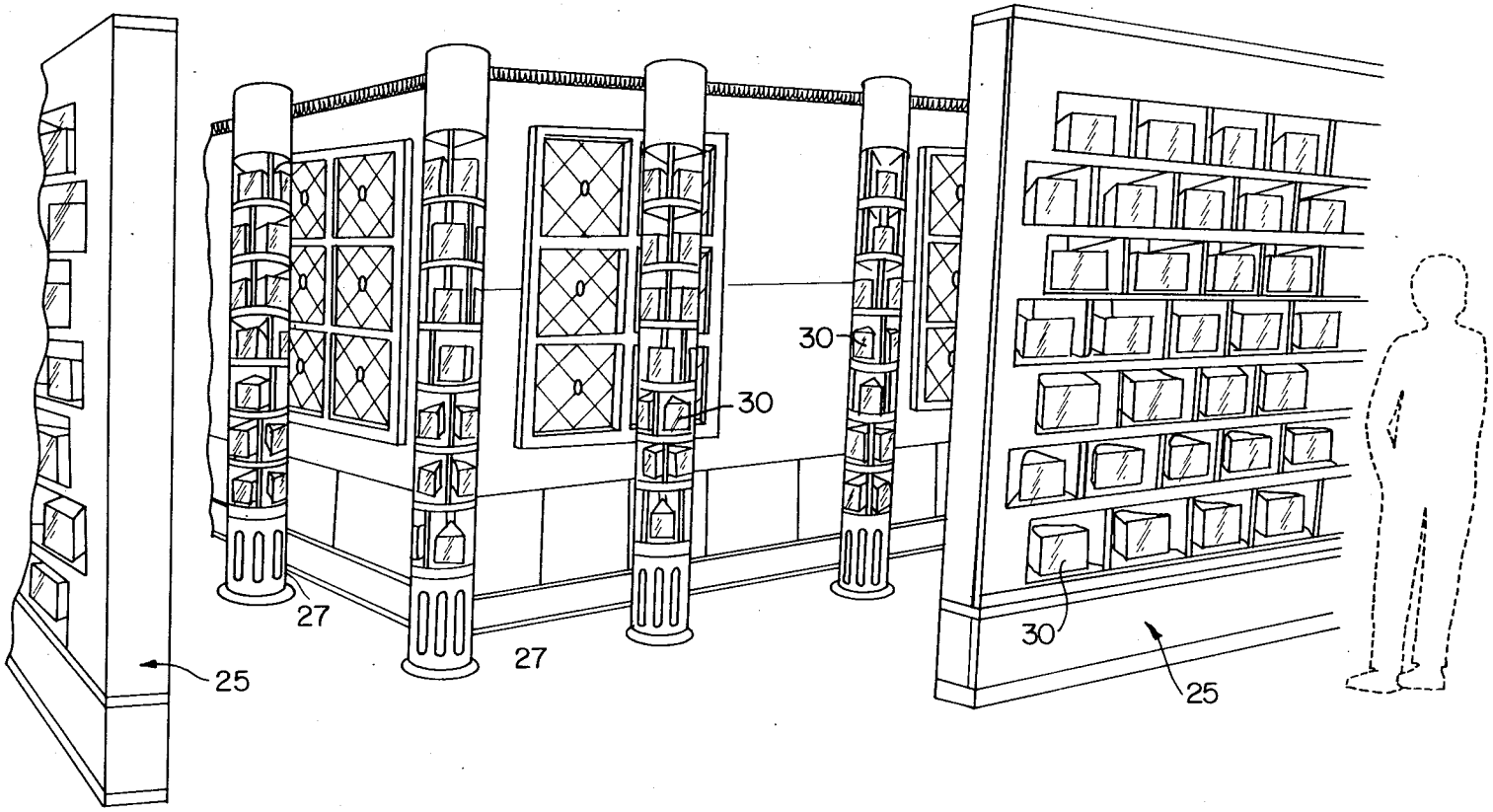
FIG. 2 is a fragmentary perspective view of the interior of the structure of FIG. 1, showing further details as to the system.

Within the complete cruciform enclosure 10, the visitor entering the door 11, as seen in FIG. 2, perceives linear multi-level displays 25 and rows of columnar multi-level displays 27. The columnar displays 27 are arranged in rows adjacent each side wall, while the linear displays 27 radiate out from the geometric center of the structure 10 along the center line of the different arms 13 and 15–17 in the enclosure 10. One walking into the enclosure structure 10 sees, as in FIG. 2, a varied display of linear and columnar displays whose ensemble effect changes dramatically as position changes. However, the self-illuminating character of each display vessel, discussed in greater detail below, aids in avoiding individual emphasis points or regions. On reaching the geometric center of the structure 10 the visitor perceives an entirely different effect, that of displays stretching in all directions. At all positions the synthesis of broad architectural aspects and evenly illuminated multiple light sources preserves the dignity and tranquil presence desirable for a mausoleum.

Figure 4:
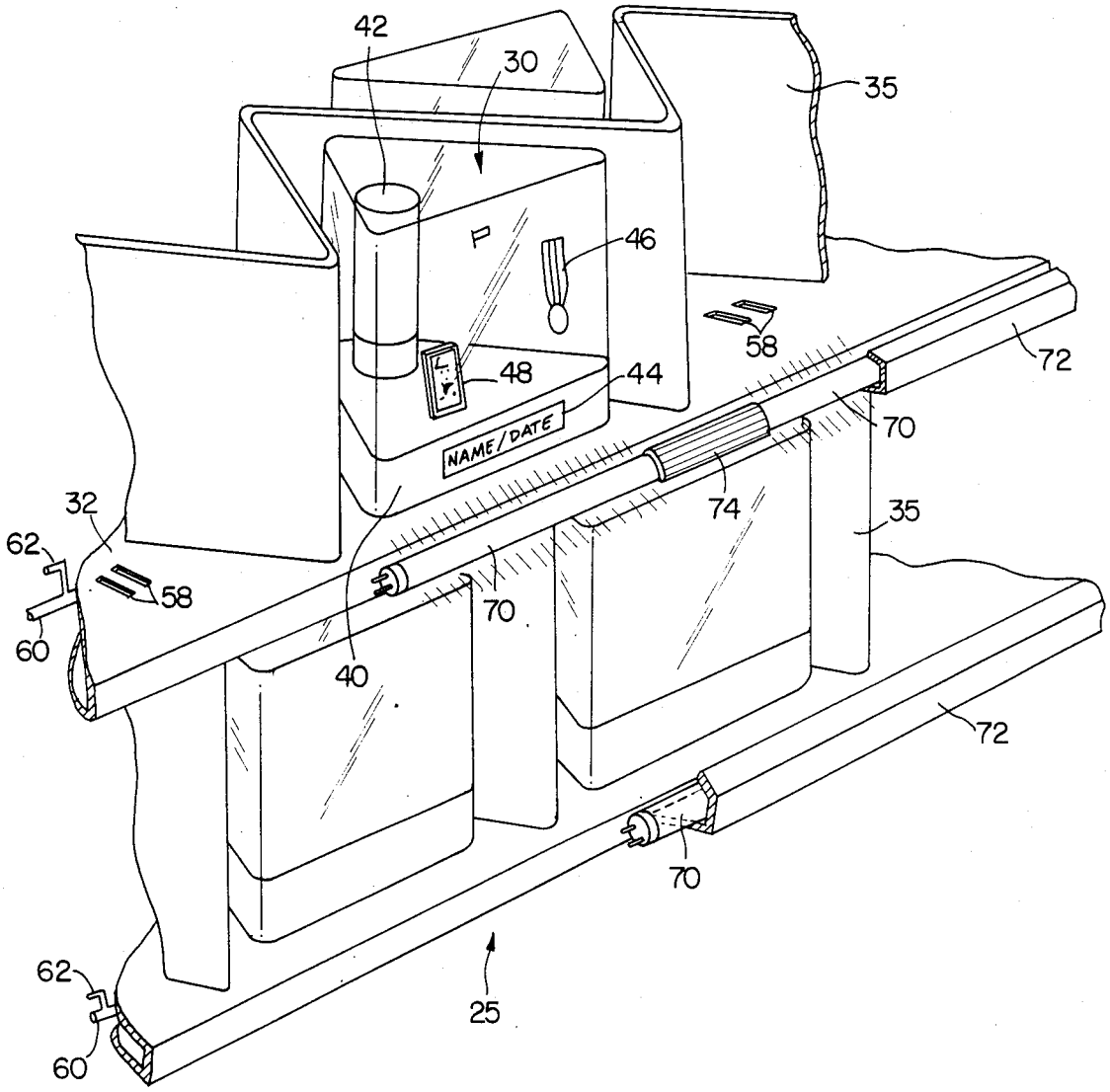
FIG. 4 is a perspective view, partially broken away, of one example of linear support in accordance with the invention.
Figure 5:
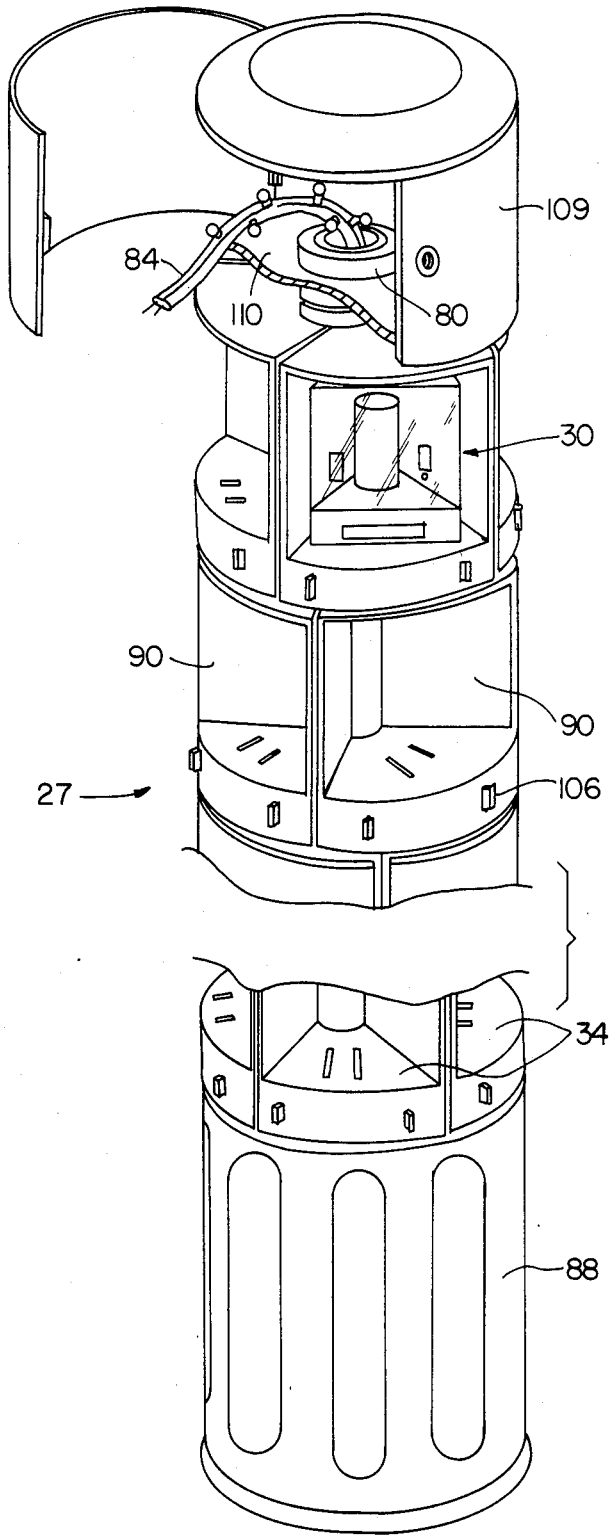
FIG. 5 is a perspective view, partially broken away, of a columnar support in accordance with the invention.

As seen in FIGS. 4–9, a multiplicity of small but visually prominent vessels 30 are disposed at successive vertical levels within the linear and columnar displays 25, 27 respectively, as seen in FIGS. 4 and 5 in perspective view. Vessels 30 are secured in horizontal rows at each horizontal level of the linear displays 25 on hollow shelves 32 (FIG. 4), and in quadrants on rotatable shelves 34 on the columnar displays 27 (FIG. 5). Diffused and nonconcentrated lighting, described below, provides freedom from shadow effects while substantially uniformly illuminating the vessels 30, whatever their disposition. In the linear and columnar displays 25, 27 respectively, only the height from approximately 20" from the floor to about 7' from the floor is used for display, so that all the vessels 30 can coveniently and readily be viewed. The vessels 30 are 8–10" on a side and in height, so a substantial number can be stored in a relatively small volume.

As seen in FIGS. 4 and 6, the vessels 30 are triangular sided, monolithic transparent structures of substantially symmetrical form, with rounded corners. Adjacent vessels 30 alternate in direction, so that a nesting relationship is achieved for greater compactness and to permit viewing from both sides of each linear display 25. The vessels 30 are made focal points for light by zig-zag or sinuous opaque and typically black barriers 35 which pass behind each vessel 30 in the row. The outer wall 36 of the vessel 30 is glass, cast or formed to be relatively thick and therefore strong and permanent. The interior comprises a cast plastic body 38 of monolithic nature that fills the entire interior of the glass wall 36. The base 40 of the vessel 30 is bonded or chemically united block of stone powder filling rsin in a variegated pattern of marble or having the appearance of semi-precious stone.

During the casting of the plastic interior body 38, a number of items, principally a decorative urn 42 containing the ashes 43 of the deceased, may be incorporated. Some memorabilia may be embedded at different levels and positions within the vessel 30, to give the appearance of being suspended in space. The urn 42 is disposed adjacent one corner of the triangular vessel 30, the viewing side therefore being through the opposite flat wall. A bottom seal 41 closes off the underside of the urn 42 in permanent fashion after the ashes 43 have been deposited. A plaque 44 containing identifying indicia is incorporated in the front of the base 40. Memorabilia or mementos, such as medals 46, photographs 48 (FIG. 4), religious symbols, and the like are embedded in suspended fashion adjacent the viewing of the vessel 30 so as to be readily visible without obscuring the view of the urn 42. This geometrical shape of vessel 30 permits alternation of vessels in a row on the linear displays 25, as seen in FIG. 4, so that they are nested together for greater compactness and more pleasing visible effect. The same vessels 30 may also be used on the different shelves on the columnar displays 27 (FIG. 5). For locking purposes, the vessels 30 include underside protrusions or stubs 50, these protrusions 50 including lateral or horizontal holes 52 through which latching elements can be inserted.

Figure 7:
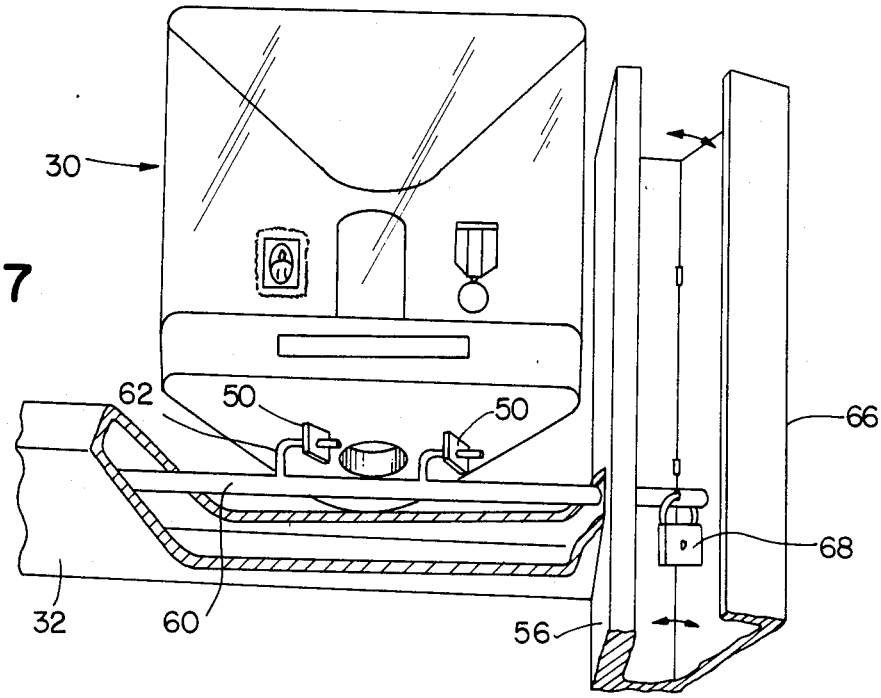
FIG. 7 is a perspective view, partially broken away, of a vessel and shelf arrangement that may be utilized in the linear support system of FIGS. 1, 2 and 4.

Referring to both FIGS. 4 and 7, the linear displays 25 are formed of successively vertically spaced apart hollow shelves 32 separated by 10" to 12" center to center spacings and seated in upstanding end panels 56. Pairs of slots 58 in the upper surface of each shelf 32 are spaced apart by selected distances along the length of the shelf, to receive the underside protrusions 50 from the individual display vessels 30. Within the hollow interior of each shelf 30 is included a longitudinally movable latching shaft 60 which extends parallel to and spaced apart from the underside protrusions of each vessel 30. A plurality of individual latch bars 62 extend from the shaft 60 so as to engage within the holes 52 in the protrusion 50 when the latch shaft 60 is moved to the secured position, thus preventing removal of any individual vessel. For greater security, metal reinforcement (not shown) may be added in the region in which the latch bars 62 engage the protrusions 50. The operative end of each latching shaft 60 is accessible through a pivotable door 66 (FIG. 7 only) in an end panel 56 supporting the shelf 32 end. Within the end panel 56, a lock 68 is engaged to the latching shaft 60 so as to prevent longitudinal movement if it should be attempted.

The linear displays 25 are illuminated by fluorescent tubes 70 (FIG. 4) running along the front of each shelf 32, with outward illumination being blocked by partially encompassing cover strips 72 that can be internally reflecting. Lengths of the tubes 70 that are not directly opposite a vessel are covered with opaque sleeving 74, although another light blocking structure can alternatively be used. Consequently, a sheet of non-focused light is directed into the interior of the vessel 30 and internally reflected, causing the urn 42 and memorabilia to be illuminated evenly, and to make the vessel appear to be self-illuminated.

Figure 9:
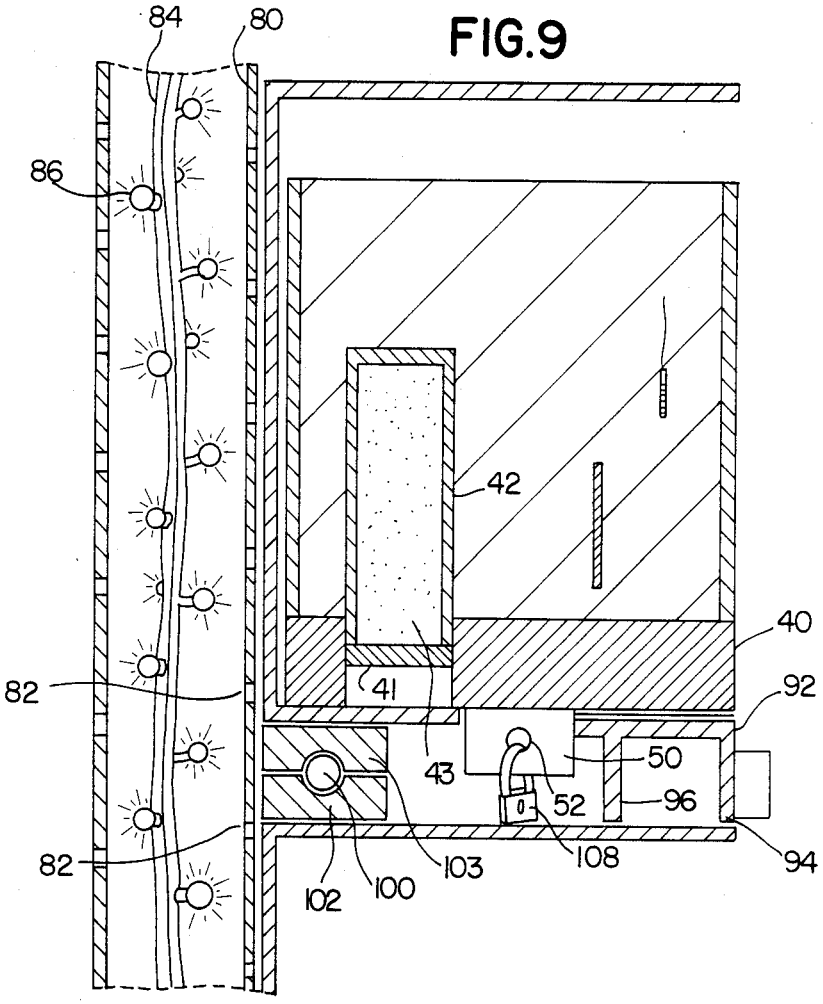
FIG. 9 is a side sectional view of a portion of the columnar display device of FIGS. 5 and 8.

Referring to FIGS. 5, 8 and 9, the columnar displays 27 are formed around hollow central shafts 80 which extend from floor to ceiling. The central shaft 80 has evenly distributed apertures 82 to permit light to pass radially outwardly from an interior light source, which may comprise fluorescent lamp tubes, a light piping system with a number of outlets, or other devices. In this example, however, a flexible insulated cable or tape 84 with embedded power lines and parallel shunt couplings is extended inside the shaft 80 to energize a sequence of small lamps 86 spaced along its length and providing illumination n all directions. Reflections inside the shaft 80 assure uniform light passage through the apertures 82. The column 27 and shaft 80 are supported on a base panel 88, and the visible exterior of the column 27 is further defined by a vertical array of quadrant niches 90, arranged in sets of four. Each set of four niches 90 forms a different storage and display level for a set of four circumferentially displaced vessels 30. The quadrant niches 90 have transparent inner walls 91, but opaque bases 92, side walls, and top. Each base 92 includes a peripheral rim 94 and an inside rim 96 on their underside, as well as slots 99 for receiving the underside protrusions 50 from the vessels 30. The compartmented column shelves formed by uniting the quadrant niches 90, as by adhesives, are made individually rotatably by incorporating ball bearings 100 with lower and upper raceways 102, 103 respectivley between the levels. The ball bearings 100 are concentric with the central shaft 80 and the upper raceway 103 supports a facing underside surface of the base panel 92 above while the lower raceway 102 rest on the upper side of the quadrant niche 90 beneath. The quadrant niches 90 fit and join together and form a unit which can be rotated freely by front handles 106. Individual locks 108 (FIG. 9) are placed on the protrusions 50 to prevent removal of the vessels 30.

Above the top column shelf a lockable hinged cover 109 conceals a lock ring 110 which secures around the central shaft 80 and which must be freed to permit upward movement of the niches 90. To gain access to the locks 68 108 install or change the vessels 30 at a particular level, therefore, one opens the hinged cover 109, loosens the lock ring 110 and slides the assembly including the desired quadrant niches 90, and all of the quadrant niches 90 above it upwardly, to gain access to the particular vessel 30 that is desired.

The columnar displays 27 are approximately 20" in diameter and are spaced apart on approximately 45" centers along the walls of the structure 10. Becasue the individual levels can be rotated, there is adequate clearance for viewers simultaneously to observe any selected vessels 30 on adjacent columns, or on the same column 27. The arrangement provides the needed aesthetic continuity, internal illumination of the vessels, security against removal but accessibility for inspection and adjustment.

Systems in accordance with the invention provide novel storage and display concepts that enable each of many compact vessel 30 to be prominently and clearly displayed on an egalitarian basis with many others. In a cruciform structure 10 having basic 10'×10' modules, as shown, over 2000 vessels 30 can be viewed and permanently stored. Using small ash-containing urns 42 as well as relatively small vessels 30, a burial location is provided for uniting decedents in accordance with some common bond in one place, without precluding like commemoration in another place having a different theme. For these purposes the spacings between the vessels 30, their individual illumination and internal reflections with high contrast against a dark background provide a multiplicity of vocal points without loss of individual emphasis. The orderly arrays of vessels 30 on the linear and columnar displays 25, 27 respectively, within the cruciform shape of the enclosure 10 provide constantly changing vistas as one walks through the enclosure. Nonetheless there is cohesion between the elements of the display to augment the variety presented by the different forms.

Figure 10:
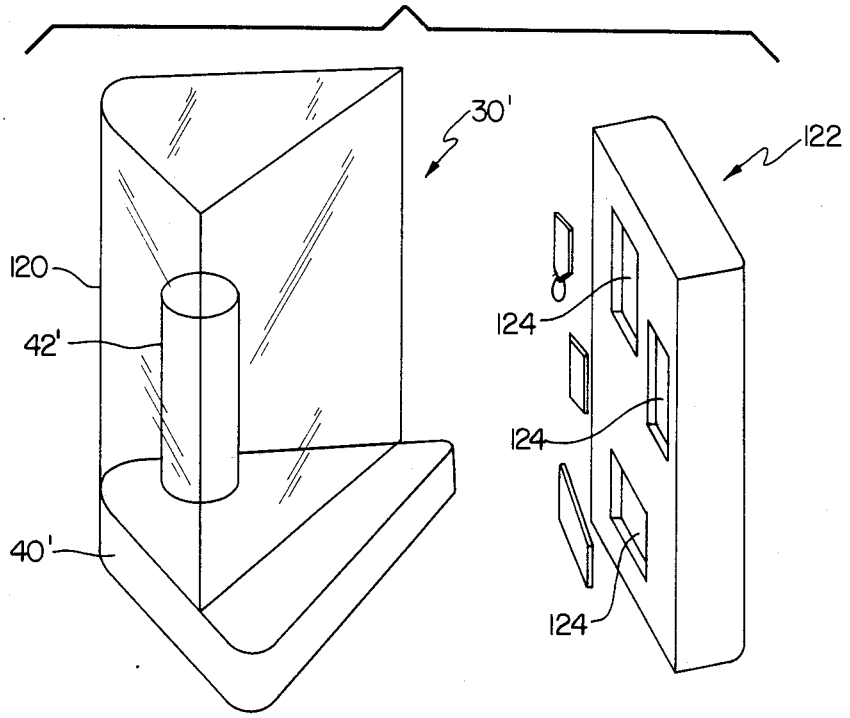
FIG. 10 is an exploded view of a different vessel in accordance with the invention.

A different vessel 30' in accordance with the invention is configured for easier fabrication and shipment, as well as management at the mausoleum. The exploded view of FIG. 10 depicts the vessel 30' as fabricated in two sections, with a common body portion 120 including an urn 42' cast in place on the base 40'. The front of the common body portion 120 is set back, so that a personalized face plate 122 can be attached on site. The common body portion 120 can thus be made, shipped and stored, and immediately available for the deposit and sealing of ashes at the mausoleum. The face plate 122 receives indicia and memorabilia in recesses 124 on the back side of the face plate 122, after which it is adhesively or mechanically attached to the front of the body portion 120. This procedure minimizes the time required for preparation and enables a wide variety of face plates to be used for customizing the display.

Although a number of variations and modifications have been described the invention is not limited thereto but encompasses all forms and variations falling within the scope of the appended claims.

What is claimed is:

1. A mausoleum for storing and displaying cremated remains from a number of individuals, comprising:

a chamber;

a number of support structures in linear and columnar form disposed within the chamber, each having means defining a successive number of display levels;

a plurality of storage vessels, each having at least one transparent and exteriorly visible portion containing means for storing the ashes of a decedent and personal memorabilia thereof, the storage vessels being disposed in ordered arrays on the levels of the support structures; and means for illuminating the vessels.

2. The invention as set forth in claim 1 above, wherein the support structures are spaced apart such as to provide passageways for viewers therebetween, and at least some of the support structures of columnar form are disposed along the walls of the chamber and are rotatable.

3. The invention as set forth in claim 2 above, wherein the support structures of columnar form each support a number of vessels at each level thereof and wherein they further include means supporting the vessels in individually rotatable fashion at each level.

4. The invention as set forth in claim 3 above, wherein the storage vessels have triangular configurations in plan and those on the support structures of linear form are alternated in direction at each level.

5. The invention as set forth in claim 4 above, including in addition means for visually isolating the oppositely facing vessels from the immediately adjacent vessels on the same level.

6. The invention as set forth in claim 5 above, wherein the triangular vessels are less than about 10 inches in height and on a side and the system includes means for releasably attaching the vessels to the display levels.

7. The invention as set forth in claim 1 above, wherein the chamber has a cruciform configuration, and wherein the columnar support structures are disposed in rows along at least a substantial portion of the walls thereof.

8. The invention as set forth in claim 7 above, wherein the display levels are from about 20 inches to about 7 feet from the floor level.

9. A storage and display system for retaining in secure but visible fashion a variable plurality of cremation storage vessels comprising:

a secure enclosure;

means within the enclosure for defining interior storage and display positions for individual vessels in separate horizontal planes;

concealed locking means disposed adjacent to the display positions in the separate planes for locking a number of vessels disposed in those planes to the storage and display positions;

a plurality of at least partially transparent vessels, including cremation storage urns, disposed at at least some of the storage positions and engaging the locking means; and means within the enclosure and disposed adjacent the display positions for illuminating the cremation storage urns through the transparent portions of the vessels.

10. The system of claim 9 above, further including a plurality of illuminating means disposed along the means defining display positions and illuminating the different vessels, and memorabilia means within the vessels.

11. A storage and display system for retaining in secure fashion a variable plurality of cremation storage vessels comprising:

a secure enclosure of cruciform shape having arms extending from a central region;

means within the enclosure for defining interior storage and display positions for individual vessels in separate horizontal planes including linear display means in the central region of the arms and rotatable display means along at least some of the walls thereof;

locking means disposed adjacent to the display positions in the separate planes for locking vessels disposed in those planes;

a plurality of at least partially transparent vessels disposed at at least some of the storage positions and engaging the locking means; and means within the enclosure for illuminating the vessels.

12. A storage and display system for retaining in secure fashion a variable plurality of cremation storage vessels comprising:

a secure enclosure;

means within the enclosure for defining interior storage and display positions for individual vessels in separate horizontal planes;

locking means disposed adjacent to the display positions in the separate planes for locking vessels disposed in those planes;

a plurality of at least partially transparent vessels comprising monolithic transparent blocks disposed at at least some of the storage positions and engaging the locking means; and means within the enclosure for illuminating the vessels, including a plurality of illuminating means disposed along the means defining display positions and positioned adjacent the vessels to provide internal reflection within the vessels.

13. The system of claim 12 above, wherein the means for defining storage and display positions comprises a number of linear display units having successive storage levels and a number of columnar display units having successive storage levels, and wherein the illuminating means for the linear display units comprises linear lighting means disposed along the front thereof and the illuminating means for the columnar display units comprises central light source means illuminating the vessels thereat.

14. The system of claim 13 above, wherein the columnar display units comprise a hollow central shaft having light apertures therein, light generating means within the shaft, and support means coupling the vessels to the shaft and configured to permit light from the shaft to illuminate the associated vessel.

15. A vessel for storage of ashes from cremated remains comprising:

a transparent block that is triangular in plan;

an urn embedded in the block and having an interior accessible from the underside of the block; and memorabilia in the block and visible through the sides of the block along with the urn.

16. A vessel as set forth in claim 15 above, wherein the vessel further comprises an opaque base on the underside thereof and the urn is mounted with an open end in the base, and means for sealing the open end of the urn after insertion of cremated remains.

17. A vessel as set forth in claim 16 above, wherein the block comprises a glass outer wall and a clear plastic cast interior containing memorabilia in suspension.

18. A vessel as set forth in claim 16 above, wherein the block comprises a body portion containing the urn and a transparent face plate having recesses for containing memorabilia, and means for attaching the face plate to the body portion.

* * * * *